US005590762A

United States Patent [19]

Harrelson

[11] Patent Number: 5,590,762

[45] Date of Patent: Jan. 7, 1997

[54] BASKET-STYLE CARRIER WITH RETAINER TABS

[75] Inventor: Glenn R. Harrelson, Roswell, Ga.

[73] Assignee: Riverwood International Corporation, Atlanta, Ga.

[21] Appl. No.: 556,865

[22] Filed: Nov. 2, 1995

Related U.S. Application Data

[63] Continuation of Ser. No. 260,848, Jun. 16, 1994, abandoned.

[51] Int. Cl.[6] ..... B65D 75/00

[52] U.S. Cl. ..... 206/162; 206/167; 206/175; 206/180

[58] Field of Search ..... 206/162, 167, 206/169, 170, 174, 175, 180, 181, 182, 183, 184, 185, 186, 187, 188, 189, 190, 191, 193, 427

[56] References Cited

U.S. PATENT DOCUMENTS

| | | | |
|---|---|---|---|
| 1,293,801 | 2/1919 | Kitt | 206/169 X |
| 1,881,900 | 10/1932 | Oman et al. | 206/169 |
| 2,097,941 | 11/1937 | Wells et al. | 206/193 X |
| 2,719,650 | 10/1955 | Buttery et al. | 206/172 |
| 2,774,512 | 12/1956 | Dunning | 206/172 X |
| 2,797,845 | 7/1957 | Guyer et al. | 206/172 |
| 2,983,406 | 5/1961 | Arneson | 206/165 |
| 3,198,379 | 8/1965 | Creelman | 206/165 |
| 3,198,381 | 8/1965 | Gioia | 206/165 X |
| 3,349,957 | 10/1967 | Wood | 206/172 X |
| 3,402,872 | 9/1968 | Forrer | 206/170 |
| 3,411,663 | 11/1968 | Moore et al. | 206/172 X |
| 3,589,553 | 6/1971 | Rossburg et al. | 206/172 |
| 4,362,240 | 12/1982 | Elward | 206/193 X |
| 4,402,400 | 9/1983 | Stout | 206/162 |

*Primary Examiner*—Jacob K. Ackun
*Assistant Examiner*—Tara Laster

[57] ABSTRACT

A basket-style carrier with means for maintaining the carrier open during loading. The carrier includes tabs foldably connected to the end panel sections at one end of the carrier. When the tabs are folded in at substantially right angles to the end panel sections, they engage a vertical support member to prevent the carrier from closing. When the articles being loaded reach the tabs, they fold the tabs up against the inside face of the end panel sections. The articles themselves maintain the carriers open at that point and the tabs are no longer needed for that purpose.

7 Claims, 3 Drawing Sheets

12
58
66
68
20
22
44
48
46
18
14
62
32
60
36
34
40
52
56

BASKET-STYLE CARRIER WITH RETAINER TABS

This is a continuation of application Ser. No. 08/260,848, filed Jun. 16 1994 now abandoned.

FIELD OF THE INVENTION

This invention relates to a basket-style carrier for carrying articles such as beverage bottles. More particularly, it relates to a basket-style carrier incorporating means for maintaining the carrier in open condition when loading articles into it.

BACKGROUND OF THE INVENTION

Basket-style carriers are commonly employed to package beverage bottles. They include a separate cell for each bottle, from which the bottles can be readily removed, and a center handle partition for easily carrying the package. The carriers are fabricated from a blank which is folded and glued into collapsed carrier form, after which the collapsed carrier is erected and the bottles inserted. In one design the bottom panel is integrally formed so that when the collapsed carrier is erected the bottles are inserted down onto the bottom panel through the open cells. In another design the bottom panel is formed by connecting bottom panel flaps after the bottles have been inserted into the cells. To insert the bottles into the cells in this latter design the collapsed carrier must not only be opened, but must be maintained open until the bottles are inserted far enough into the carrier to hold the carrier open. Normally, packaging machine elements are made to initially maintain the carrier in open condition until the bottles are inserted to this point. This complicates the design of the packaging machine, however, and can be a limitation on the speed of the machine.

It would be highly desirable to be able to maintain the erected carrier in open condition by means other than packaging machine elements without complicating the carrier design or making it more expensive.

BRIEF SUMMARY OF THE INVENTION

The invention applies to any basket-style article carrier required to be held open during loading of articles until the articles enter the carrier cells a sufficient distance to themselves be able to hold the carrier open. At least one of the end panels of such a carrier is comprised of two adjacent end panel sections, each being connected to an associated side panel and to an inwardly extending vertical support member. A retainer tab connected along a fold line to a substantially horizontal edge of each end panel section extends inwardly from the end panel section. The tab extends in a transverse direction, engaging the vertical support member to hold the carrier open during loading, and is folded against the interior face of the associated end panel section after the carrier has been loaded.

In a carrier where the cells are defined by straps extending from a handle panel, the vertical support member is a riser panel which is foldably connected to the end panel sections. In a carrier where the cells are defined by dividers extending from a combined center support panel and handle panel, the vertical support member is the combined panel. The tabs may be connected to either the upper or lower edge of the end panel sections and may be provided at either or both ends of the carrier.

These and other features and aspects of the invention will be readily ascertained from the detailed description of the preferred embodiments described below.

DETAILED DESCRIPTION OF THE PREFERRED EMBODIMENTS

Figure 1:
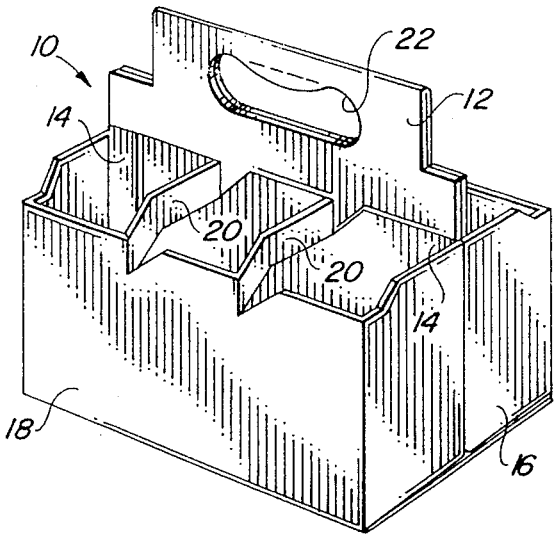
FIG. 1 is a pictorial view of a basket-style carrier incorporating the invention.

Referring to FIG. 1, the basket-style carrier 10 of the invention includes a central handle panel 12 connected to riser panels 14 which in turn are connected to end panels 16. The end panels are connected to side panels 18, and the side panels are connected to a bottom panel, not visible in this view. Individual cells for receiving bottles or other articles are formed by straps 20 which extend from the side panels 18 to the handle panel 12. The handle panel includes a handle opening 22 and the carrier includes retainer tabs, not shown in this view, which function to hold the carrier open during loading in a manner described in detail below.

Figure 2:
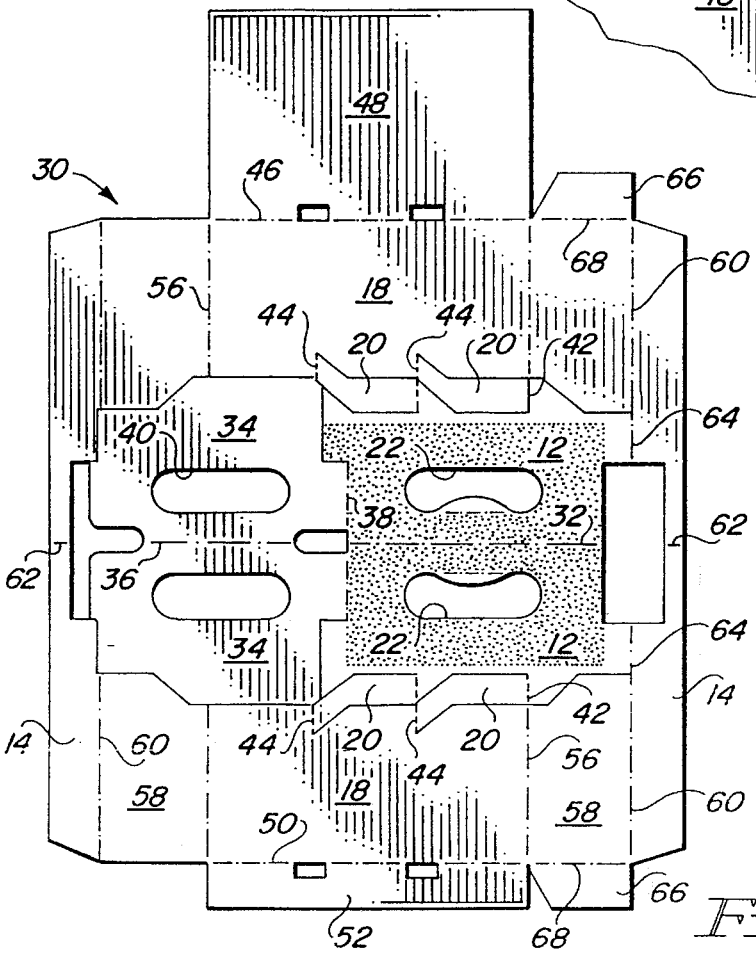
FIG. 2 is a plan view of a blank for fabricating the carrier.

Referring to FIG. 2, wherein like reference numerals to those used in FIG. 1 denote like elements, a blank 30 for forming the carrier is shown as being of generally rectangular shape. Preferably, the blank is formed from paperboard of the type conventionally used in the carrier industry. Centrally located at the right side of the blank are two similar outer handle panel sections 12 connected together by fold line 32. Immediately to the left of the panel sections 12 are two similar inner handle sections 34, which are connected to each other by fold line 36 and to the panel sections 12 by fold line 38. The inner handle panel sections 34 contain handle openings 40 which are adapted to underlay the handle openings 22 in a carrier formed from the blank, and the fold line 36 is an extension of the fold line 32. Cutouts at the ends of the fold line 36 facilitate folding.

One end of each of the straps 20 is connected to the outer handle panel sections 12 by fold line 42 while the other end is connected to the side panel sections 18 by fold line 44. One of the side panel sections 18 is connected along fold line 46 to bottom panel flap 48, and the other side panel section is connected along fold line 50 to glue flap 52. Preferably, the fold lines 46 and 50 include cutouts to facilitate folding. The side panel sections 18 are connected by fold lines 56 to end panel sections 58, which in turn are connected along fold lines 60 to riser panel sections 14 at opposite ends of the blank. Fold lines 62, which are continuations of the fold lines 32 and 36, connect the riser panel sections at each end of the blank and fold lines 64, which are continuations of the fold lines 60, connect the riser panel section at the right of the blank to the outer handle panel sections 12. Other than the edges of the handle panel sections formed by fold lines 38, 42 and 64, the edges of the handle panel sections are formed by slits, producing free edges when the blank is formed into a carrier.

The carrier blank described thus far is typical of a blank for forming a basket-style carrier whose cells are separated by straps. In accordance with the invention, in addition to the elements described the blank also includes retainer tabs or flaps 66 connected to the ends of the end panel sections 58 at the right side of the blank along fold lines 68, which are extensions of the fold lines 46 and 50.

Figures 3, 4, 5:
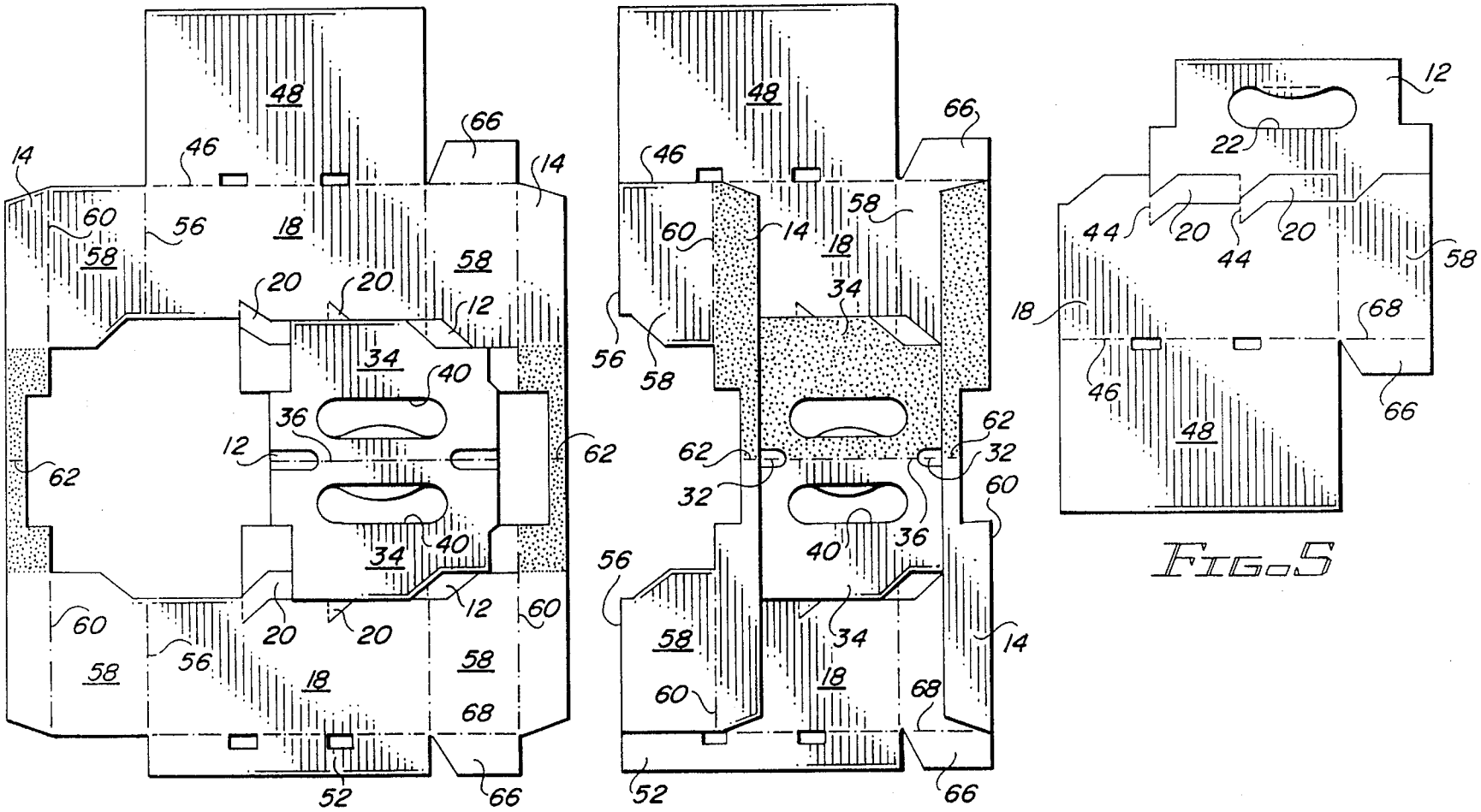
FIG. 3 is a plan view of the carrier blank after an initial folding step.
FIG. 4 is a plan view of the carrier blank after a second series of folding steps.
FIG. 5 is a plan view of a collapsed carrier resulting from a final folding step.

To form a carrier from the blank the outer handle panel sections 12 are coated with adhesive, as shown in stipple, and the inner handle panel section 34 is pivoted about fold line 38 onto the outer handle panel section 12. The blank with the adhered handle panel sections appears as illustrated in FIG. 3. The next step is to apply adhesive to the areas of the riser panel sections shown in stipple in FIG. 3, then fold the left end panel sections 58 about the fold lines 56 and the right riser panel sections 14 about the fold lines 60. These steps result in the interim form of blank shown in FIG. 4.

The final sequence of the forming operation is to apply adhesive to the stippled areas of the riser panel sections 14 and the inner handle panel section 34 shown in FIG. 4 and then fold the blank about the fold lines 62, 36 and 32. This produces the collapsed carrier illustrated in FIG. 5, in which the end panels formed from the end panel sections 58 at the right of the blank extend out from the side panels 18 in folded condition and the end panels formed from the end panel sections at the left of the blank are inwardly folded between the side panels. The tabs 66 and the bottom panel flap 18 are still in unfolded condition at this point.

Figure 6:
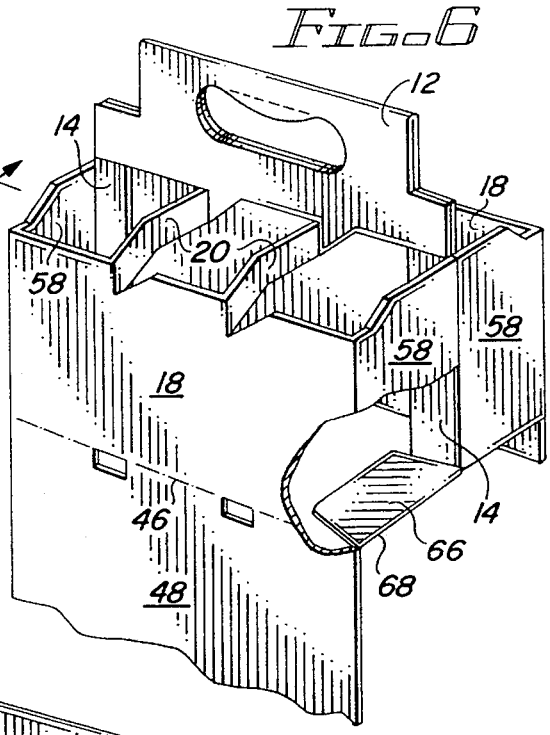
FIG. 6 is a pictorial view of an erected carrier prior to forming the bottom panel, a portion of the carrier being removed to reveal a retainer tab in activated position.

To form a loaded carrier from the collapsed carrier of FIG. 5, the collapsed carrier is squared up by pressing the outer ends of the outwardly extending end panel sections toward the opposite end, as is well known in the industry. At this point the tabs 66 are folded up about their fold lines 68 so as to extend in toward the interior of the carrier, as illustrated in FIG. 6. For purpose of clarity only one tab has been shown in this view, although it will be understood that both tabs will have been folded in the same manner. The side edges of the tabs in this position contact the adjacent riser panel 14. When the squaring-up force is withdrawn the carrier tends to fold back to its collapsed condition but is prevented from doing so by the engagement between the retaining tabs and the riser panel. The tabs thus retain the carrier in erected condition with the cells open to receive bottles during loading.

Figure 7:
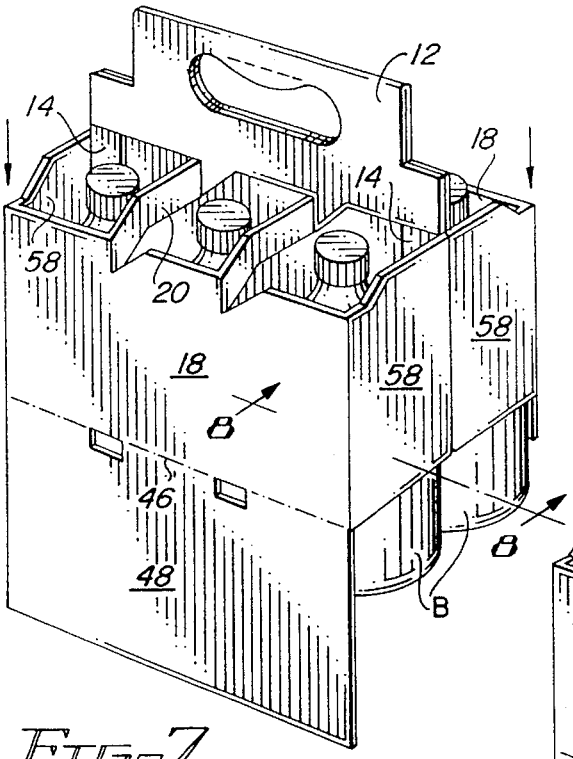
FIG. 7 is a pictorial view of an erected carrier during the process of loading bottles into it.
Figure 8:
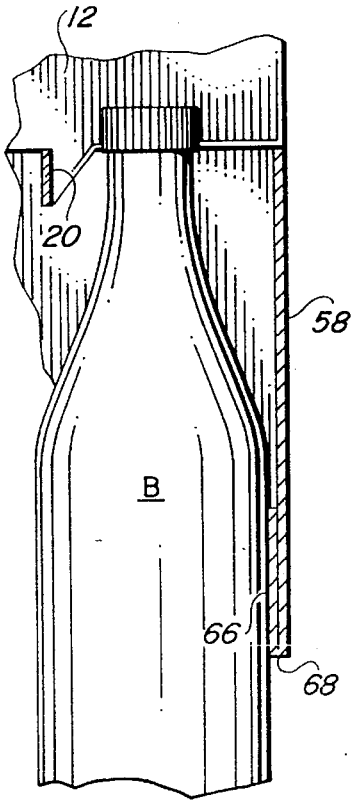
FIG. 8 is an enlarged partial sectional view taken on line 8—8 of FIG. 7.

As illustrated in FIG. 7, the open carrier is then lowered onto the bottles B, with the bottom panel flap 48 and the glue flap 52 still unfolded. When the inwardly folded retainer tabs 66 contact the bottles during the carrier lowering step the tabs are caused to fold up out of the way against the inner face of the end panels, as shown in FIG. 8. The retainer tabs thus maintain the carrier in erected condition during the critical time prior to entry of the bottles into the cells, but do not interfere with relative movement between the bottles and the carrier after the bottles have gained entry to the cells. After the opened carrier has been pushed down over the bottles to its final position, the bottom panel flap 48 and the glue flap 52 are folded in and glued together in overlapped condition as the last step in forming the finished carrier.

Although retainer tabs may be provided at the lower end of both end panels if desired, this is not normally necessary, as retainer tabs at only one end will normally adequately maintain the carrier in erected condition.

Figure 9:
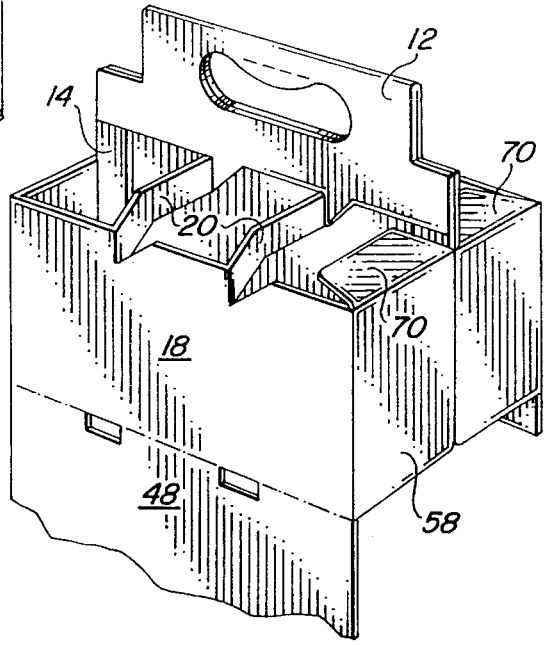
FIG. 9 is a pictorial view of a modified arrangement in which the retainer tabs are located at the upper edges of the end panel sections.

The invention is not limited to the provision of retainer tabs at the bottom edge of the end panel sections. It will be understood that they would be provided at the top instead if the loading procedure requires relative upward movement of the carrier with respect to the bottles. FIG. 9 is illustrative of such an arrangement, wherein the retainer tabs 70 are connected to the upper edges of the end panel sections 58 instead of the lower edges. The tabs 70 would function in the same manner as described in connection with the first embodiment.

Figure 10:
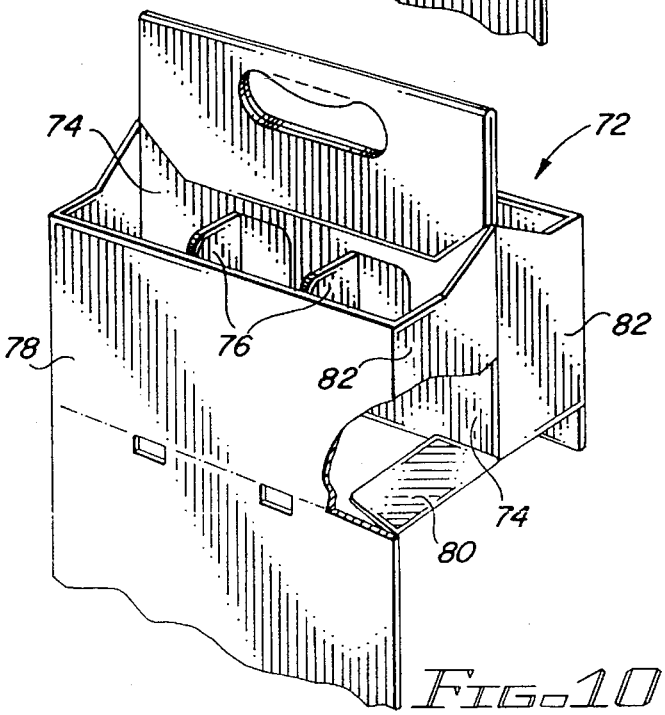
FIG. 10 is a pictorial view similar to that of FIG. 6, but showing a different type of basket-style carrier.

It should be understood that the invention is not limited to the carriers shown in FIGS. 1–9. For example, the retainer tabs shown in FIG. 10 function in the same manner as the retainer tabs in FIGS. 1–9 even though the carrier is of a somewhat different design. In the carrier 72 of FIG. 10 there are no separate riser panels connected to an upper handle panel. Instead, the carrier includes a combined handle panel and center support panel 74 which extends substantially down to the bottom panel, and the dividers 76 extend out to the side panels 78 from the support panel 74. The retainer tabs 80, which are connected to the lower edge of the end panel sections 82, contact the support panel 74 to hold the carrier open in the same manner as in the embodiments of FIGS. 1–8. Basically, any basket-style carrier which needs to be held open for a period of time during the loading process until the bottles enter the cells to a sufficient extent to hold the carrier open can be provided with retaining tabs.

It should now be appreciated that the use of retainer tabs overcomes a longstanding problem in a simple, economical, yet highly efficient manner. It will be apparent that although the invention has been described in connection with a carrier designed for holding bottles, it applies equally as well to carriers designed to hold other types of articles instead. It is contemplated that the invention need not necessarily be limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. In an open-top basket-style article carrier having opposite side panels connected to a bottom panel, means for dividing the carrier into a plurality of cells, an article in each cell, the carrier being of the type formed from a unitary blank and required to be held open during loading of the articles until the articles enter the cells a sufficient distance so as to themselves be able to hold the carrier open, end panels connected to the side panels, each end panel being comprised of two adjacent end panel sections, each of said end panel sections having an interior face, an outer edge connected to an associated side panel and an inner edge foldably connected to an inwardly extending vertical support member, the improvement comprising:

each of said end panel sections of at least one of the end panels having an upper edge and a lower edge lower edge being a substantially horizontal edge; and a tab connected along a fold line to each said substantially horizontal edge, each tab being in folded position engaging the interior face of an associated end panel section and an adjacent article, the tabs when folded to a position extending transversely of the associated end panel sections during loading of the articles into the carrier cells engaging the vertical support member to hold the carrier open.

2. A basket-style article carrier as defined in claim 1, wherein the substantially horizontal edge of each of said end panel sections is the upper edge of that end panel section.

3. A basket-style article carrier as defined in claim 1, wherein each inwardly extending vertical support member is a riser panel.

4. A basket-style article carrier as defined in claim 1, wherein each inwardly extending vertical support member is a handle panel.

5. A collapsed open-top basket-style article carrier formed from a unitary blank and required to be held open during loading of articles until the articles enter the carrier for a sufficient distance so as to themselves hold the the carrier open, comprising:

opposite side panel sections having end edges;

means connected to the side panel sections for dividing the carrier into a plurality of cells for receiving articles;

at least one bottom panel flap connected at one edge along a fold line to at least one of the side panel sections, the bottom panel flap having an unconnected opposite free edge;

an end panel section having an outer edge connected to the end edge of each side panel section along a fold line;

each end panel section having an interior face, an inner edge connected along a fold line to an inwardly extending support member and a lower transverse edge extending between said outer edge and said inner edge; and a tab connected along a fold line to the lower transverse edge of each of two adjacent end panel sections, the tab being folded inwardly of the associated end panel section to engage the inwardly extending support member to hold the carrier open during loading, the tab being folded against the interior face of the associated end panel section after the carrier has been loaded.

6. A collapsed basket-style article carrier as defined in claim 5, wherein each inwardly extending support member is a riser panel.

7. A collapsed basket-style article carrier as defined in claim 5, wherein each inwardly extending support member is a handle panel.

* * * * *